United States Patent [19]

Turko et al.

[11] 3,956,977

[45] May 18, 1976

[54] FUME HOOD WITH REMOVABLE ENCLOSURE PANELS

[75] Inventors: Michael Turko, Manitowoc; David F. Huempfner, Kewaunee, both of Wis.

[73] Assignee: American Hospital Supply Corporation, Evanston, Ill.

[22] Filed: Nov. 18, 1974

[21] Appl. No.: 524,571

[52] U.S. Cl. ..... 98/115 LH; 24/81 B; 312/257 A; 312/257 SK; 312/257 SM

[51] Int. Cl.[2] ..... F23J 11/00

[58] Field of Search ..... 312/257 R, 257 A, 257 SM, 312/257 SK; 98/115 LH, 115 R; 24/81 B

[56] References Cited

UNITED STATES PATENTS

| | | | |
|---|---|---|---|
| 1,374,868 | 4/1921 | White et al. | 312/257 SK |
| 2,791,323 | 5/1957 | Schreckengost et al. | 312/257 R X |
| 3,370,521 | 2/1968 | Honerkamp | 312/257 R X |
| 3,505,945 | 4/1970 | Greer | 98/115 LH |
| 3,523,716 | 8/1970 | Roggio, Jr. et al. | 312/257 R |

*Primary Examiner*—William O'Dea
*Assistant Examiner*—Ronald C. Capossela

[57] ABSTRACT

A fume hood is provided with a plurality of removable enclosure panels which cover various components of the hood to which access is necessary from time to time. The panels which must be removed most often are each removable independently of the other panels, and the fasteners for all of the panels are hidden.

8 Claims, 19 Drawing Figures

FUME HOOD WITH REMOVABLE ENCLOSURE PANELS

BACKGROUND AND SUMMARY

Fume hoods generally include outlets for gases, compressed air, water, and electricity and also a light fixture and switch. These are integral components of the hood and must be accessible for (1) initial connection at the time of installation, (2) inspection by code authorities for the municipality in which the hood is installed, and (3) maintenance and repair.

Gaining access to these components of fume hoods is generally a difficult and time-consuming procedure. Many hoods must be partially disassembled before such access is obtained, and some hoods are equipped with unsightly access doors which are built into the exterior panels.

The foregoing problems are eliminated by the present invention. Each of the exterior panels of the hood is easily removable, and each of those panels which are generally removed most often can be removed without removing any of the other panels. The securing means for all of the panels are hidden, and the removability of the panels does not interfere with the overall neat appearance of the hood or with the cleaning of the hood.

DESCRIPTION OF THE DRAWING

The invention will be explained in conjunction with an illustrative embodiment shown in the accompanying drawing, in which.

DESCRIPTION OF SPECIFIC EMBODIMENT

Figure 1:
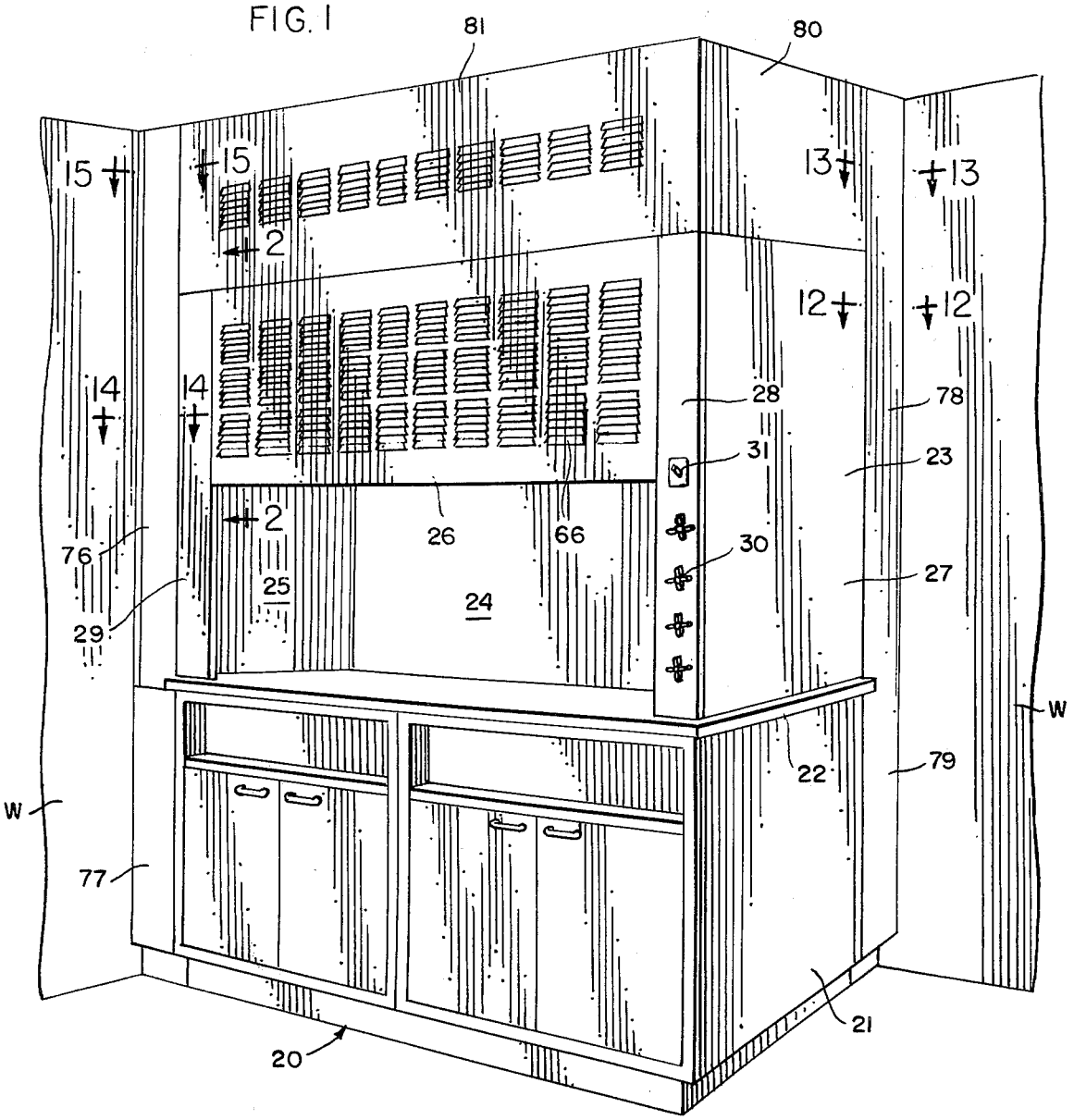
FIG. 1 is a perspective view of a fume hood equipped with removable enclosure panels in accordance with the invention.

Referring first to FIG. 1, the numeral 20 designates generally a fume hood which includes a base 21 with a countertop 22 and a super structure 23 which is supported by the countertop. The super structure 23 includes a rear wall 24, a pair of side walls 25, and a front panel 26 which define a working chamber above the countertop. The lower edge of the front panel 26 terminates above the countertop to provide an access opening for the working chamber, and the fume hood may be equipped with a conventional sash which can be raised and lowered behind the front panel 26 to close the access opening when desired.

A side enclosure panel 27 is spaced laterally outwardly of the right side wall 25, and the conventional plumbing and electrical conduit for gases, compressed air, water, and electricity are positioned within the space between the right side wall and the side enclosure panel 27. The front of the space between the right side wall and the side enclosure panel is covered by a right side front access panel 28, and a similar left side front access panel 29 covers the front edge of the left side wall 25 and extends laterally to the left. The outlets for the gases and water are controlled by faucet handles 30 which are mounted on shafts which extend through the front access panel 28, and an electrical switch 31 controls the electric power for the light mounted inside the fume hood.

With the exception of the outer panels of the fume hood and the manner of mounting them, the fume hood is conventional, and a detailed description of the fume hood and its components such as the plumbing, electrical conduit, light, etc. is unnecessary.

Figure 5:
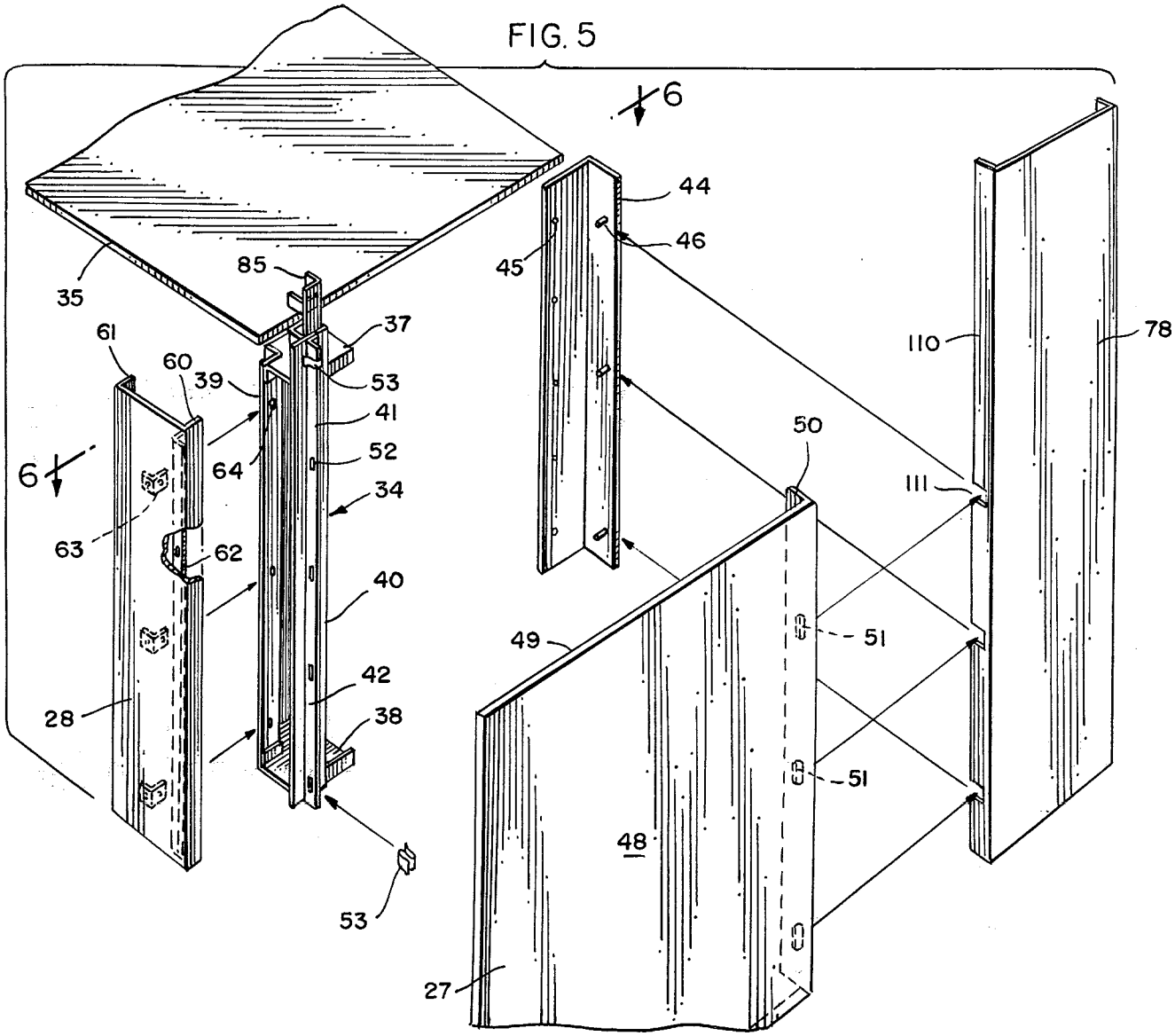
FIG. 5 is a fragmentary exploded perspective view showing the removal of the front access panel, side enclosure panel, and rear enclosure panel.
Figure 9:
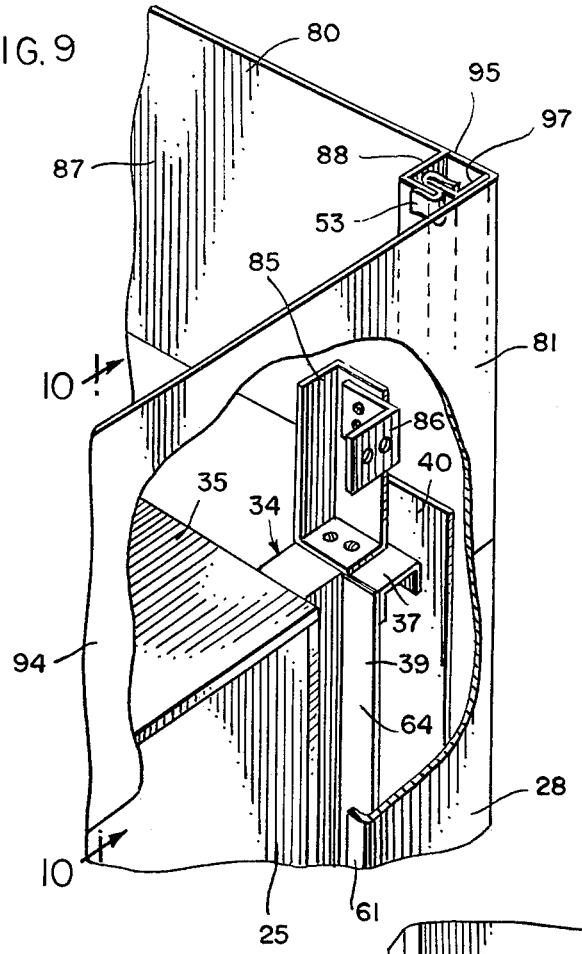
FIG. 9 is a fragmentary perspective view of the upper right corner of the fume hood.

Referring now to FIGS. 5 and 9, the right side wall 25 (FIG. 9) is secured to a front corner post assembly 34, and a top wall 35 is secured to the top edges of the two side walls and the rear wall 24 (FIG. 1). The front corner post assembly 34 includes top and bottom horizontally extending plates 37 and 38, a vertically extending angle 39 which is secured to the horizontal plates in right angular recesses formed therein, and a vertically extending plate 40 which is also secured to both of the horizontal plates. The flat plate 40 extends parallel to the side wall 25, and an angle 41 is secured to the outer surface of the plate and provides a laterally outwardly extending flange 42.

The front left corner of the fume hood includes a similar corner post assembly 34 to which the left side wall 25 is secured.

A rear mounting angle 44 (FIG. 5) is secured to the rear portion of the right side wall 25 by screws which extend through openings 45 in one of the legs of the angle. Three mounting studs 46 extend forwardly from the other leg of the angle.

Still referring to FIG. 5, the side enclosure panel 27 includes a flat central wall portion 48 and an inwardly extending peripheral flange 49 which extends around the upper, lower, and front edges of the central wall 48. A rear flange 50 extends inwardly from the rear edge of the central wall and is slightly longer than the flange 49. The rear flange 50 is provided with three elongated openings 51 which are spaced to receive the support studs 46 on the rear mounting angle 44.

Figure 7:
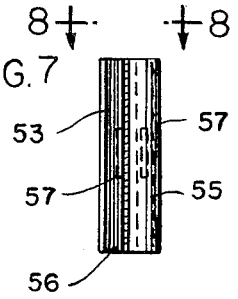
FIG. 7 is a front elevational view taken along the line 7—7 of FIG. 8 of one of the S-shaped fastening clips.
Figure 8:
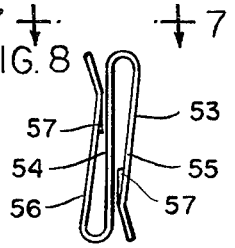
FIG. 8 is a top plan view of the fastening clip taken along the line 8—8 of FIG. 7.

The laterally outwardly extending flange 42 on the right corner post assembly is provided with five vertically spaced slots 52, and an S-shaped attaching clip 53 is retained on the flange by each slot. The attaching clip 53 is illustrated in FIGS. 7 and 8 and includes a central web 54 and right and left spring leg portions 55 and 56. The outer end portion of each of the leg portions diverges away from the web portion 54 to facilitate insertion of a member between the leg and the web. A prong 57 is lanced inwardly from each leg portion toward the web, and the prong enters the slot 52 in the flange of the corner post and prevents removal of the clip from the flange unless the leg portion is separated from the web of the clip.

The side enclosure panel 27 is mounted on the fume hood by moving the rear edge of the side enclosure panel toward the rear mounting angle 44 until the mounting studs 46 pass through the openings 51 in the rear flange of the side enclosure panel. The front edge of the panel is then pressed toward the front corner post until the vertically extending front portion of the peripheral flange 49 is pressed into the S-shaped attaching clips which are mounted on the corner post. A snug, rattle-free fit of the side enclosure panel is obtained by positioning the rear mounting angle 44 so that the rear leg of the mounting angle must be pushed rearwardly slightly in order to press the front flange 49 of the side enclosure panel into the attaching clips. The resilience of the rear mounting angle will then hold the side enclosure panel tightly against the attaching clips.

Figure 6:
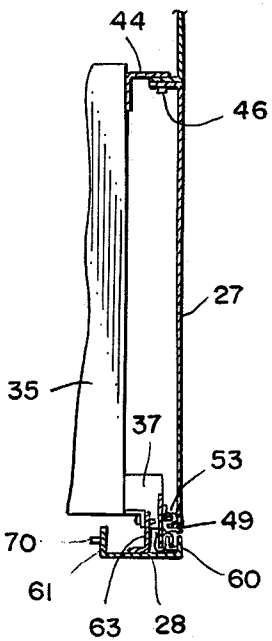
FIG. 6 is a view as would be seen along the line 6—6 of FIG. 5 when the panels of FIG. 5 are secured.

The front access panel 28 includes a pair of inwardly extending side or end flanges 60 and 61 (FIG. 5), and an angle 62 (see also FIG. 6) is attached to the inside surface of the front access panel and provides another rearwardly extending flange spaced laterally inwardly from the right flange 60. Three mounting brackets 63 are also secured to the inside surface of the front access panel, and the mounting brackets and the rearwardly extending flange of the angle 62 are spaced apart approximately the same distance as the angle 39 and the plate 40 of the corner post assembly. The rearwardly extending flange of the angle 62 is provided with a plurality of vertically spaced slots, and an S-shaped attaching clip 53 is secured to the flange by each slot. The front access panel is secured to the corner post assembly by pressing the attaching clips against the forward edge of the flat plate 40. Thereafter, the mounting brackets 63 can be attached by screws to the angle 39 of the corner post, the angle being provided with screw holes 64. The spacing of the angle 62 from the end flange 60 on the front access panel is such that the end flange 60 extends flush with the outer surface of the side enclosure panel 27 as shown in FIG. 6, and the end flange 60 extends up to the flange 49 of the side enclosure panel to minimize the spacing between these panels.

The left front access panel 29 is the mirror image of the panel 28 and is secured in a similar manner to the left front corner post assembly.

Figure 2:
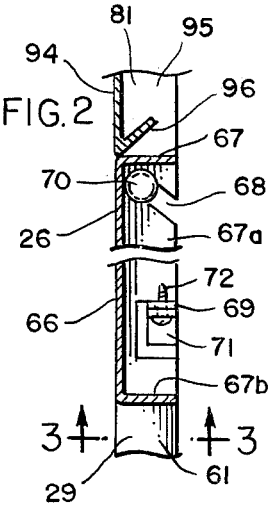
FIG. 2 is a fragmentary sectional view showing the mounting of the lower front panel.
Figure 3:
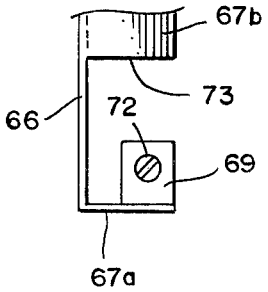
FIG. 3 is a fragmentary view taken along the line 3—3 of FIG. 2.
Figure 4:
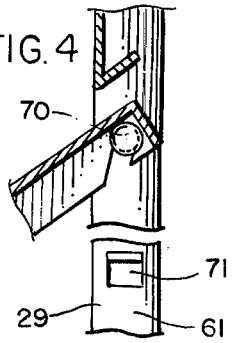
FIG. 4 is a view similar to FIG. 2 showing the removal of the lower front panel.

Referring now to FIGS. 2–4, the front panel 26 includes a louvered central wall 66 and a rearwardly extending peripheral flange 67. The left side portion **67*a* of the flange 67 is provided with a forwardly and upwardly inclined slot 68 in the upper portion thereof, and a tab 69 is lanced inwardly from the flange 67*a* near the lower portion thereof. Each of the right and left front access panels 28 and 29 is provided with a laterally inwardly extending mounting stud 70 (see also FIG. 6) and an L-shaped attaching bracket 71 which extend laterally inwardly from the inside end flange 61** of the access panel.

The front panel 26 is mounted by hooking the slot 68 over the mounting studs 70 on the right and left front access panels as shown in FIG. 4 and then swinging the front panel on the studs until the front panel becomes flush with the front access panels. The tab 69 on each side of the front panel will then be positioned over the corresponding attaching bracket 71 on the front access panel, and the tab can be secured to the bracket by a screw 72. In order to facilitate insertion of the screw, the bottom portion **67*b* of the peripheral flange can be cut away below the tab as at 73 (FIG. 3**) to permit a screwdriver to be inserted upwardly through the bottom portion of the flange.

The fume hood illustrated in FIG. 1 is positioned in the corner of a room, and only one side enclosure panel 23 is therefore required. The space between the left front access panel 29 and the wall W of the room is covered by a front side enclosure panel 76 and a front base enclosure panel 77. Similarly, the space between the rear of the right side of the fume hood and the wall is covered by a side rear enclosure panel 78 and a side base enclosure panel 79.

The side enclosure panel 23 and the front panel 26 extend upwardly to a point slightly above the top wall 35 of the fume hood. It is frequently desirable to close the space between the top of the fume hood and the ceiling of the room, and this is done by the upper side enclosure panel 80 and the upper front enclosure panel 81. Once the panels 76–81 are secured in place, it is not necessary to remove these panels for servicing the hood. Accordingly, these panels can be mounted in a more permanent fashion than the panels heretofore described.

Referring now to FIG. 9, a corner post extension 85, which is L-shaped in horizontal cross section is attached with screws to the top horizontal plate 37 of the right front corner post. An L-shaped attaching bracket 86 is secured to the upper end of the corner post extension.

Figure 11:
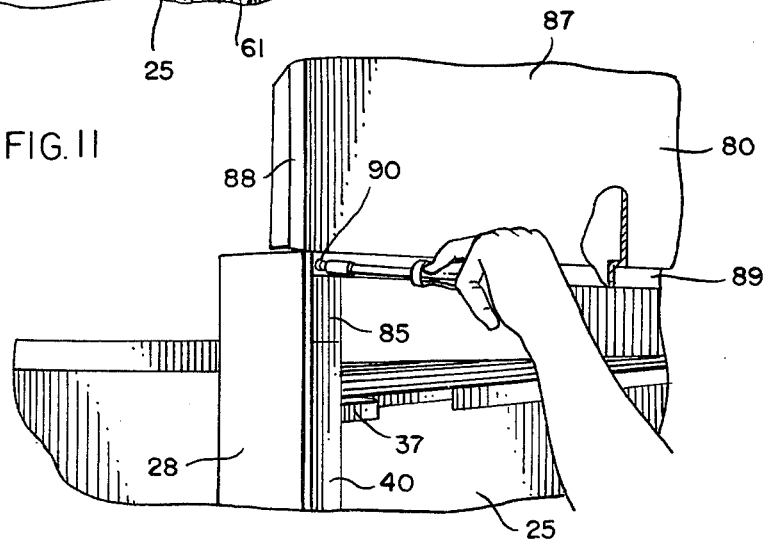
FIG. 11 is a perspective view showing the attachment of the upper side enclosure panel.

The upper side enclosure panel 80 includes a flat central wall 87 and an L-shaped front end flange 88 which extends first laterally inwardly from the flat central wall 87 and then forwardly. The bottom of the upper side enclosure panel 80 includes an L-shaped bottom flange 89 (FIG. 11) which extends first inwardly and then downwardly. The lower front of the upper side enclosure panel 80 is secured to the corner post extension 85 by a screw 90 which is inserted through an opening in the downwardly extending portion of the bottom flange 89 as shown in FIG. 11. The lower rear portion of the top side enclosure panel 80 is secured to an angle 91 (FIG. 13) which is secured to rear mounting angle 44 (FIG. 5) and which extends upwardly beyond the top wall. The downwardly extending portion of the bottom flange 89 is secured to the flange 91 by a screw 92.

Figure 10:
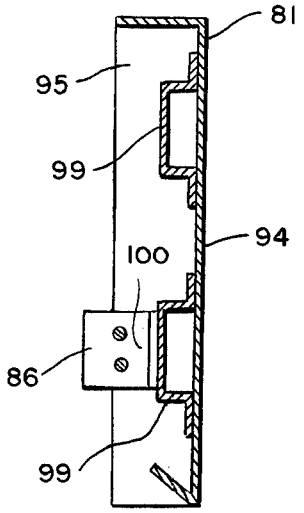
FIG. 10 is a sectional view of the upper front enclosure panel taken along the line 10—10 of FIG. 9.

Again referring to FIG. 9, the top front panel 81 includes a flat central wall portion 94, a rearwardly extending end flange 95, and an upwardly angled bottom flange 96 (FIG. 10). An angle 97 is secured to the rear surface of the central wall portion 94 and provides a rearwardly extending flange spaced inwardly of the end flange 95. The upper front enclosure panel 81 is secured to the upper side enclosure panel 80 by a plurality of S-shaped attaching clips 53, which are retained on the front flange 88 of the top side enclosure panel 80 (FIG. 11). The upper front enclosure panel 81 is also secured to the attaching bracket 86 on the corner post extension 85. Referring to FIG. 10, a pair of hat-shaped channels 99 are attached to the inside surface of the flat central wall 94 of the upper front panel, and the lower channel 99 is secured to the bracket 86 by a pair of screws 100. If additional securement is desired, a longer corner post extension can be used so that an additional bracket can be secured to the upper hat section 99. The end flange 95 of the upper front panel 81 is seen to be flush with the central wall portion 87 of the upper side enclosure panel 80 when the panels are secured in place.

Figure 15:
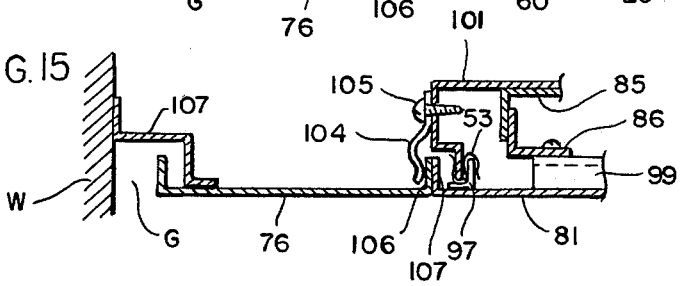
FIG. 15 is a fragmentary sectional view taken along the line 15—15 of FIG. 1.

The attachment of the left side of the top front panel 81 is illustrated in FIG. 15. The lower hat section 99 is secured to the attaching bracket 86 of the corner post extension 85 of the left front corner post assembly in the same way as on the right side. The angle 97 is attached by means of S clips 53 to a mounting angle 101 which is secured to the corner post extension 85 and extends upwardly therefrom.

If the fume hood were not positioned in the corner of a room and a left side upper side enclosure panel similar to the panel 80 could be used on the left side of the fume hood, the angle 101 would be eliminated.

Figure 14:
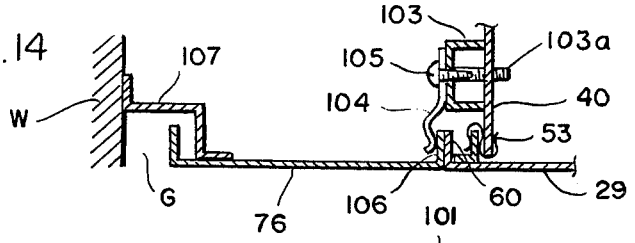
FIG. 14 is a fragmentary sectional view taken along the line 14—14 of FIG. 1.

The attachment of the front side enclosure panel 76 is illustrated in FIGS. 14 and 15. A channel 103 is secured to the flat plate 40 of the left front corner post assembly by screws 103*a* and a plurality of vertically spaced spring clips 104 are attached to the channel by screws 105. The spring clips 104 hold the end flange 106 of the front side enclosure panel 76 against the end flange 60 of the left front access panel 29. The left front access panel 29 is attached to the left front corner post assembly by S clips 53 and by attaching brackets (not shown) in the same manner as described with respect to the right front access panel.

The width of the front side enclosure panel 76 is selected to cover as much of the distance between the left front access panel and the wall W as possible. However, in most cases a slight gap G will remain. An angle 107 is then suitably secured to both the wall W and the inside surface of the front side enclosure panel, as by adhesive, to support the left side of the panel. The gap G can then be covered by a scribe as will be described hereinafter.

FIG. 15 illustrates the manner of attaching the front side enclosure panel 76 above the top wall of the fume hood, i.e., above the top of the front corner post assembly. The flange 106 of the front side enclosure panel is held against an end flange 107 on the upper front panel 81 by spring clips 104 which are secured to the angle 101 by screws 105.

Figure 12:
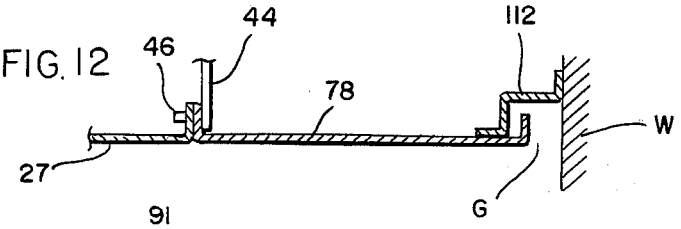
FIG. 12 is a fragmentary sectional view taken along the line 12—12 of FIG. 1.
Figure 13:
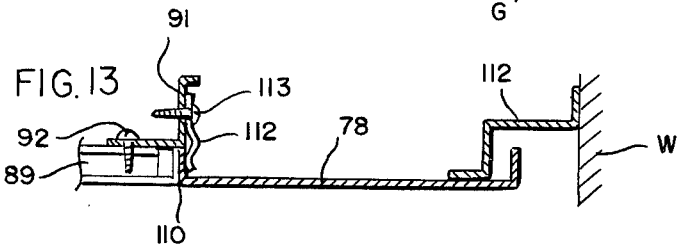
FIG. 13 is a fragmentary sectional view taken along the line 13—13 of FIG. 1.

FIGS. 12 and 13 illustrate the manner of mounting the side rear enclosure panel 78. The portion of the side rear enclosure panel which extends up to the top of the rear mounting angle 44 is supported by the mounting studs 46 on the rear mounting angle. As can be seen in FIG. 5, the front end flange 110 of the side rear enclosure panel is provided with three notches 111 which are inserted over the mounting studs 46. The width of the side rear enclosure panel 78 is selected to cover as much of the space between the rear mounting angle 44 and the wall W as possible, but a slight gap G may remain. The rear portion of the side rear enclosure panel is supported by an angle 112 which is suitably secured to both the wall and to the inside surface of the panel 78, as by adhesive.

FIG. 13 illustrates the manner of securing the side rear enclosure panel 78 above the top of the rear mounting angle 44. The front end flange 110 of the panel 78 is pressed against the rear end flange of the side enclosure panel 80 by a spring clip 112 which is secured to the angle 91 by a screw 113 near the top of panel 80.

Figure 16:
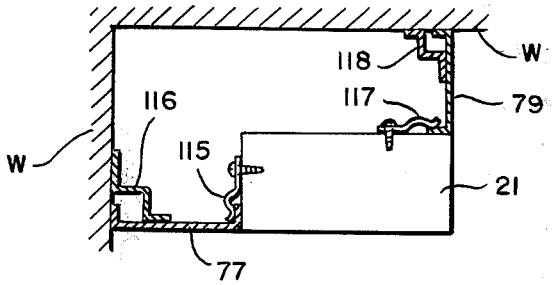
FIG. 16 is a schematic view illustrating the attachment of the side and rear enclosure panels to the base cabinet.

The manner of securing the front base enclosure panel 77 and the side base enclosure panel 79 is illustrated schematically in FIG. 16 for ease of illustration. FIG. 16 is not drawn to scale, and the base 21 of the fume hood would be substantially larger than the size illustrated in FIG. 16. The front base enclosure panel 77 is secured to the base by spring clips 115 which are secured to the base and by an angle 116 which is secured to both the panel and to the wall, as by adhesive. Similarly, the panel 79 is secured to the base by spring clips 117 and by an angle 118 which is secured to both the panel and to the wall.

Figure 17:
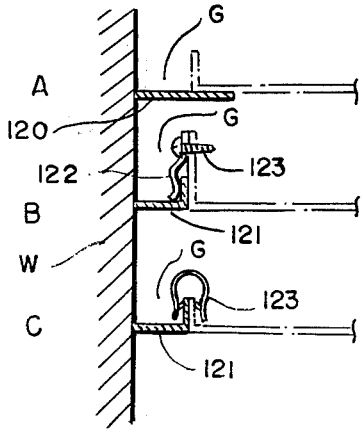
FIGS. 17A, B, and C are views illustrating various scribing means for covering the gap between the wall of the room and the side or rear enclosure panels.

Three different scribes for covering the gaps G between the front side enclosure panel and the wall are illustrated in FIGS. 17A–C. In FIG. 17A, a strip of painted light gauge metal 120 covers the gap G and overlaps the appropriate enclosure panel and is secured thereto by adhesive. In FIG. 17B, an angle 121, which can be formed of metal or extruded plastic, covers the gap and is secured to the flange of the panel by spring clips 122 which are secured to the panel by screws 123. In FIG. 17C, the angle 121 is secured to the panel by U clips 123. In each case the side of the scribe which contacts the wall is cut to fit the contour of the wall before the scribe is secured.

From the foregoing, it will be apparent how the various panels of the fume hood are mounted and removed. When the fume hood is assembled, the panels 76, 77, 78, 79, 80, and 81, which seldom require removal, are mounted on the fume hood and base. The right and left front enclosure panels 28 and 29 are secured to the right and left front corner post assemblies. The faucet handles 30 can then be mounted on the valve connections which extend through openings in the access panel, and the mounting plate for the switch 31 can be attached to the access panel.

The lower front panel 26 is mounted by hooking the slots 68 over the support studs 70 as illustrated in FIG. 4, swinging the panel downwardly to the position of FIG. 2, and inserting the screws 72.

The side enclosure panel 27 is mounted as previously described, and when the side enclosure panel is secured, the downwardly extending flange 89 of the upper side enclosure panel 80 is concealed.

The side enclosure panel 27 and the lower front panel 26 conceal areas which most frequently require accessibility. Each of these panels can be mounted and removed independently of the other, thereby facilitating maintenance. The lower front panel 26 conceals the light which is mounted in the top wall of the fume hood, and removal of the lower front panel 26 permits access to the light for servicing. The side enclosure panel 27 encloses the plumbing, electrical conduit for the light, etc.

After the lower front panel 26 and the faucet handles 30 are removed, the right front access panel 28 can be removed. This panel is also removed independently of the side enclosure panel 27.

The fume hood described and illustrated in the drawings is positioned in the corner of a room, thereby eliminating the need for side enclosure panels on the left side of the hood. However, if it is desired to position the left side of the fume hood away from the wall, a left side enclosure panel and a left upper side enclosure panel which are mirror images, respectively, of the right side enclosure panels 27 and 80 can be mounted on the left side of the hood in the same way as described for the right side enclosure panels. A left side rear enclosure panel and a left side base enclosure panel corresonding to the panels 78 and 79 can also be used to close the space between the rear of the fume hood and the wall.

While in the foregoing specification a detailed description of a specific embodiment of the invention was set forth for the purpose of illustration, it is to be understood that many of the details hereingiven may be varied considerably by those skilled in the art without departing from the spirit and scope of the invention.

We claim:

1. In a fume hood having a rear wall and a pair of side walls providing a working chamber, a pair of generally vertically extending front corner posts for supporting the front ends of the side walls, a front access panel, a side enclosure panel, and attaching means for removably attaching the front access panel and the side enclosure panel to one of the front corner posts so that the attaching means are hidden from view from outside of the fume hood, said one corner post having a first vertically extending flange extending laterally outwardly therefrom and a second vertically extending flange extending forwardly therefrom, the side enclosure panel having a vertically extending front flange at the front edge extending inwardly parallel to the first flange of said one corner post, the attaching means including clip means removably securing the front flange of the side enclosure panel to the first flange of said corner post, the front access panel having a first vertically extending side flange extending rearwardly therefrom and a second vertically extending flange spaced laterally inwardly from the side flange and extending rearwardly parallel to the side flange and to the second flange of said one corner post, the attaching means including clip means removably securing the second flange of the front access panel to the second flange of said one corner post, the side flange and the second flange of the front access panel being spaced apart a distance sufficient to permit the side flange to extend substantially flush with the side enclosure panel.

2. The structure of claim 1 including a rear support member extending generally vertically upwardly adjacent the rear wall and the rear edge of the side wall which is secured to said one corner post and having a plurality of forwardly extending studs, the side enclosure panel having a vertically extending rear flange extending laterally inwardly from the rear edge thereof, each stud extending through an opening in the rear flange of the side enclosure panel to support the rear thereof.

3. The structure of claim 1 in which the front access panel includes a plurality of rearwardly extending brackets spaced laterally inwardly of the second flange of the front access panel, each bracket being secured to said one front corner post by a screw.

4. The structure of claim 1 in which each of the clip means comprises an S-shaped spring clip secured to one flange of a corner post thereby frictionally securing the corner post to a flange of the enclosure panel associated therewith.

5. The structure of claim 1 including a second front access panel removably secured to the other of said corner posts, each of the front access panels having an inner vertically extending flange extending rearwardly from the inner edge thereof and stud means extending laterally inwardly from the inner flange, and a front panel swingably supported by the stud means.

6. The structure of claim 5 in which the front panel includes a side flange extending rearwardly from each side thereof, each of the side flanges of the front panel being provided with a slot adjacent the upper end thereof receiving one of the stud means on the front access panels, a portion of each side flange below the slot being bent laterally inwardly to provide an opening in the side flange and an attaching tab, a bracket on the inner flange of each front access panel extending laterally inwardly through the opening in the adjacent side flange of the front panel, and a screw securing each bracket to the associated attaching tab.

7. The structure of claim 1 including a rear support member extending generally vertically upwardly adjacent the rear wall and the rear edge of the side wall which is secured to said one corner post and having a plurality of forwardly extending studs, the side enclosure panel having a vertically extending rear flange extending laterally inwardly from the rear edge thereof, each stud extending through an opening in the rear flange of the side enclosure panel to support the rear thereof, a second front access panel removably secured to the other of said corner posts, each of the front access panels having an inner vertically extending flange extending rearwardly from the inner edge thereof and stud means extending laterally inwardly from the inner flange, and a front panel swingably supported by the stud means, an upper side enclosure panel secured to said one front corner post and the rear support member above the side enclosure panel, the upper side enclosure panel having a flat central wall, an L-shaped horizontally extending bottom flange having a first portion extending inwardly from the bottom of the central wall and a second portion extending downwardly from the inner end of the first portion, an L-shaped vertically extending front flange having a first portion extending inwardly from the front of the central wall and a second portion extending forwardly from the inner end of the first portion, the second portion of the bottom flange extending below the top of the side enclosure panel and inwardly thereof and being secured to said one front corner post and the rear support member, the outer surfaces of the upper side enclosure panel and the first side enclosure panel being substantially flush, and an upper front panel above the front panel, the upper front panel having a vertically extending end flange extending rearwardly from one side edge of the upper front panel substantially flush with the outer surface of the upper side panel and a vertically extending inner flange spaced inwardly of the end flange, and clip means releasably attaching the inner flange of the upper front panel and the second portion of the front flange of the upper side panel.

8. The structure of claim 7 in which the other end of the upper front panel is secured to the other corner post.

* * * * *